US006070329A

United States Patent [19]

Gibbs

[11] Patent Number: 6,070,329

[45] Date of Patent: Jun. 6, 2000

[54] KNIFE AND HANDLE CONSTRUCTION AND METHOD OF FABRICATING SUCH KNIVES

[75] Inventor: Philip Gibbs, Camillus, N.Y.

[73] Assignee: Camillus Cutlery Co., Camillus, N.Y.

[21] Appl. No.: 08/885,889

[22] Filed: Jun. 30, 1997

[51] Int. Cl.[7] ..... B25G 1/00

[52] U.S. Cl. ..... 30/344; 30/340; 30/345

[58] Field of Search ..... 30/340, 343, 344, 30/345; 16/431

[56] References Cited

U.S. PATENT DOCUMENTS

| | | | |
|---|---|---|---|
| 3,813,729 | 6/1974 | Szabo et al. | 16/119 |
| 4,712,304 | 12/1987 | Sanelli | 30/343 |
| 4,837,892 | 6/1989 | Lo | 30/343 X |
| 5,528,834 | 6/1996 | Seber et al. | 30/340 |
| 5,740,586 | 4/1998 | Gomas | 16/111 R |
| 5,794,347 | 8/1998 | Serpa | 30/162 |
| 5,862,571 | 1/1999 | Naft et al. | 16/111 R |

*Primary Examiner*—Rinaldi I. Rada
*Assistant Examiner*—Ana Luna
*Attorney, Agent, or Firm*—George R. McGuire; Hancock & Estabrook, LLP

[57] ABSTRACT

A knife handle formed of two diverse materials includes a frame of rigid, thermosetting plastic having external surfaces and an elongated, internal cavity. A somewhat rubbery, resilient material covers portions of both the external surfaces and the cavity walls of the frame. The cavity is open at the distal end of the handle and is of substantially rectangular cross section. The resilient material covers all four walls of the cavity from the open end for a portion of its length, and covers only the two longer sides within the main body of the frame. A tang extending integrally from the knife blade is inserted into the cavity, contacting only the resilient material, with interference fit, within the cavity. Assembly is completed by inserting a rivet through aligned openings in the tang and handle, the handle openings being entirely surrounded by the resilient material.

19 Claims, 4 Drawing Sheets

KNIFE AND HANDLE CONSTRUCTION AND METHOD OF FABRICATING SUCH KNIVES

BACKGROUND OF THE INVENTION

The present invention relates to knife handles formed of two moldable, interconnected materials, to knives incorporating such handles and to methods of fabricating such knifes.

Knife handles are fabricated from a wide variety of natural and synthetic materials, or combinations of two or more materials. Somewhat resilient or pliable materials have been used as coverings for rigid knife handles to provide a more comfortable, cushioned grip. Problems arise, however, from separation of the two materials and, in non-folding, fixed-blade knives, in attachment of the blade tang to the handle.

It is an object of the present invention to provide a novel and improved knife handle construction having a core or frame of rigid material with surface portions covered by a resilient material wherein the two materials are essentially inseparable.

Another object is to provide a novel method of fabricating a fixed-blade knife with a handle comprising two initially moldable materials, one of which is rigid and the other resilient after curing, with improved connection of the tang to the handle.

A further object is to provide a knife having a handle with a frame of rigid material partially covered by a resilient material wherein the tang does not contact the rigid handle material.

Other objects will in part be obvious and will in part appear hereinafter.

SUMMARY OF THE INVENTION

In the disclosed embodiment, the handle is fabricated by forming in a first mold a frame of hard, rigid material such as a suitable form of nylon. The frame includes wall means defining an elongated cavity extending longitudinally essentially between proximal and distal ends of the frame. The frame is then placed in a second mold where portions of both its outer surfaces and the cavity walls are covered by a layer of a second material which, when cured, is somewhat resilient. The handle consists of the two, sequentially molded materials.

The outer surface of the frame is exposed in elongated areas on both sides of the finished handle and in a laterally extending portion at the distal end, as well as in a plurality of narrow strips near the proximal end, and is otherwise covered by the resilient material. The frame cavity is essentially rectangular in cross section. The resilient material covers all four walls of the cavity in an area extending inwardly from the distal end. Thus, the rectangular opening at the distal end of the handle is entirely surrounded by the resilient material. The two wider sides of the cavity walls are covered by the resilient material throughout the length of the cavity, thereby providing parallel, spaced, opposing surfaces. The resilient material also forms an abutment within the cavity at the proximal end. Also, the walls of aligned openings in the frame on opposite sides of the cavity adjacent the proximal end are covered by the resilient material. These openings are provided for passage of a rivet which also passes through an opening in the tang to secure the tang and blade to the handle.

After the handle is formed, a tang extending integrally from the knife blade is inserted into the cavity in the handle.

The tang is of uniform width and thickness, having a length between its juncture with the blade and a rounded end portion substantially equal to the length of the cavity. The thickness of the tang is slightly greater than the space between the opposing walls of the resilient material within the cavity, whereby the major surfaces of the tang are force-fitted and firmly engaged between such walls. The width of the tang is less than the distance between the narrower cavity walls, which are not covered by the resilient material, thereby providing an open space between the side edges of the tang and the rigid frame.

The tang is secured to the handle by a rivet passing through the aligned openings in opposite sides of the handle and an opening in the tang. The rivet contacts only the tang and the resilient material surrounding the openings in the handle. The terminal end of the tang contacts the abutment surface formed by the resilient material within the cavity at the proximal end of the handle.

The foregoing and other features of construction and method of fabrication of the handle and knife will be more readily understood and fully appreciated from the following detailed description, taken in conjunction with the accompanying drawings.

DETAILED DESCRIPTION

Figure 1:
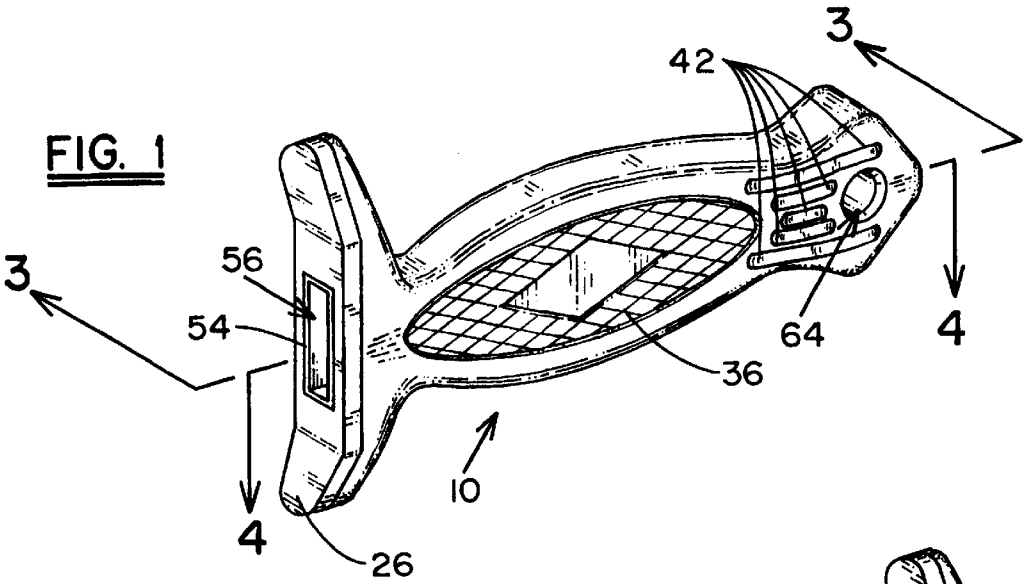
FIG. 1 is a perspective view of the knife handle of the invention.
Figure 2:
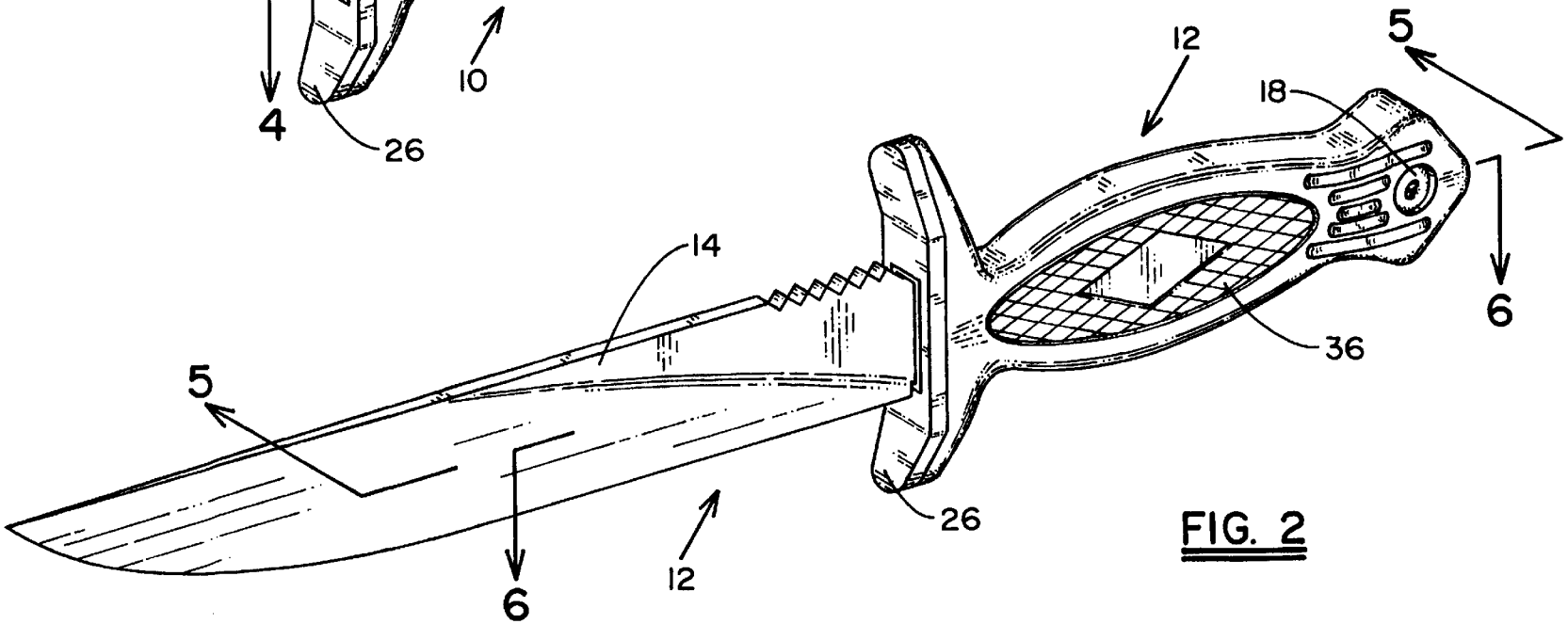
FIG. 2 is a perspective view of the fully assembled knife.

Referring now to the drawings, the fully assembled handle and knife are denoted generally by reference numerals 10 and 12 in FIGS. 1 and 2, respectively. Knife 12, in addition to handle 10, includes blade 14 having integral tang portion 16, seen in FIGS. 5 and 6, extending into a cavity provided for such purpose in handle 10. Rivet 18 extends through aligned openings in opposite sides of handle 10 and through an opening in tang 16 to permanently affix handle 10 to blade 14, as explained in more detail hereinafter.

Figure 7:
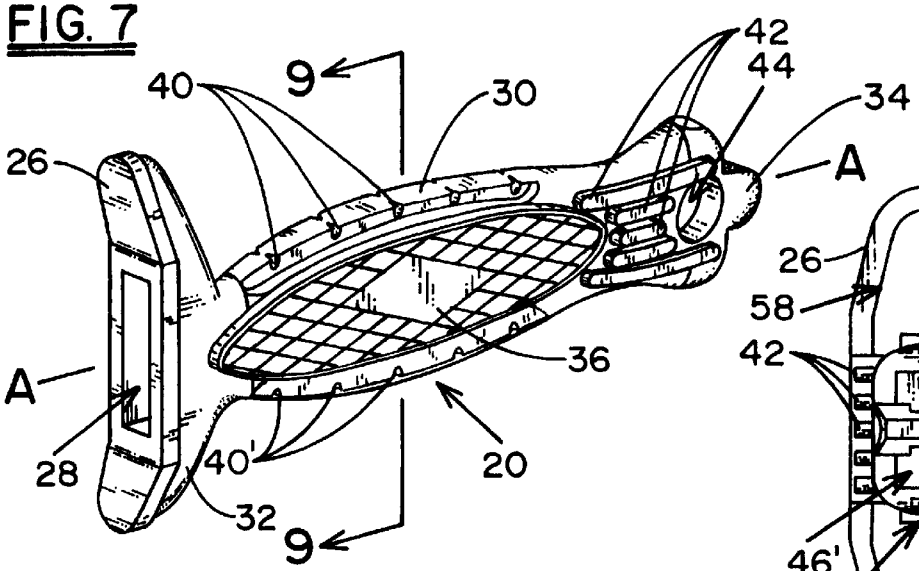
FIG. 7 is a perspective view of the frame portion of the handle.

Handle 10 is formed of two diverse materials. Frame 20, shown separately in FIG. 7, is fabricated of a hard, rigid, dimensionally stable, thermosetting plastic. A preferred material is that sold by Dupont under the trademark Aqualoy. Frame 20 is partially covered, both externally and within an internal cavity, by a second material which is somewhat resilient or "rubbery" in texture. A preferred material is that sold by Shell Chemical Corp. under the trademark Kraton.

Figure 8:
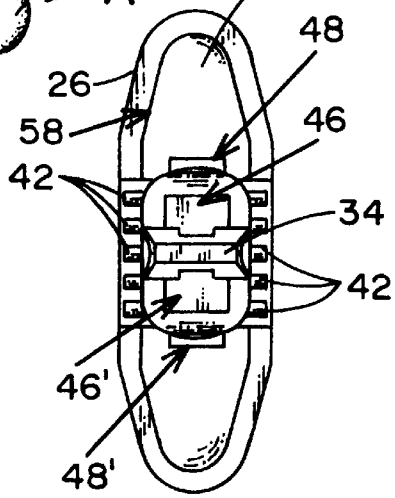
FIG. 8 is an end view of the frame portion.

In the preferred method of fabrication of knife 12, frame 20 is first formed to the configuration of FIG. 7 by conventional injection molding techniques in a first mold represented in FIG. 8 by the block numbered 22. Frame 20 is then placed in second mold 24 where the second material is applied thereto in the desired areas to complete fabrication of handle 10. Guard portion 26, at what is termed the distal end of frame 20, includes rectangular opening 28 elongated transversely to major axis A—A. The length of the longer sides of opening 28 is indicated in FIG. 3 by the letter L.

Guard 26 is integrally joined to body portion 30 of frame 20 by transitional portion 32. Body 30 extends from transitional portion 32 to the proximal end of frame 20 where protrusion 34 extends outwardly along axis A—A. Side pieces 36 and 38, having equally sized, substantially oval shaped peripheries are raised from the surrounding portions of body 30 on opposite sides thereof. Although side piece 38 is seen only in section in FIGS. 4 and 6, it will be understood that the appearance of frame 20 is essentially the same on the opposite side as on the side seen in FIG. 7.

Figure 9:
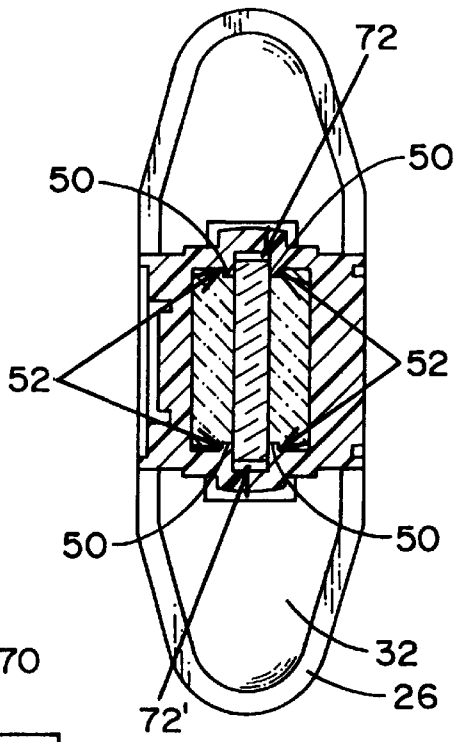
FIG. 9 is an enlarged, elevational view in section on the line 9—9 of FIG. 7.

A first series of small, longitudinally spaced passageways 40 extend laterally through body 30 on one side thereof, and a second series 40' extends through the opposite side. Generally longitudinal ribs 42, having outer surfaces substantially in the planes of side pieces 36 and 38, extend outwardly from opposite sides of body 30 adjacent the proximal end of frame 20. The two outer ribs extend along opposite sides of through opening 44. Body 30 is hollow, defining a generally rectangular, enclosed cavity extending longitudinally of frame 20 from opening 28 to the proximal end of the frame. Openings 46 and 46' (FIG. 8) communicate with the cavity at the proximal end on opposite sides of protrusion 34, as do openings 48 and 48', portions of which are seen in FIGS. 8 and 9 at the juncture of transitional portion 32 with body 30.

Figure 3:
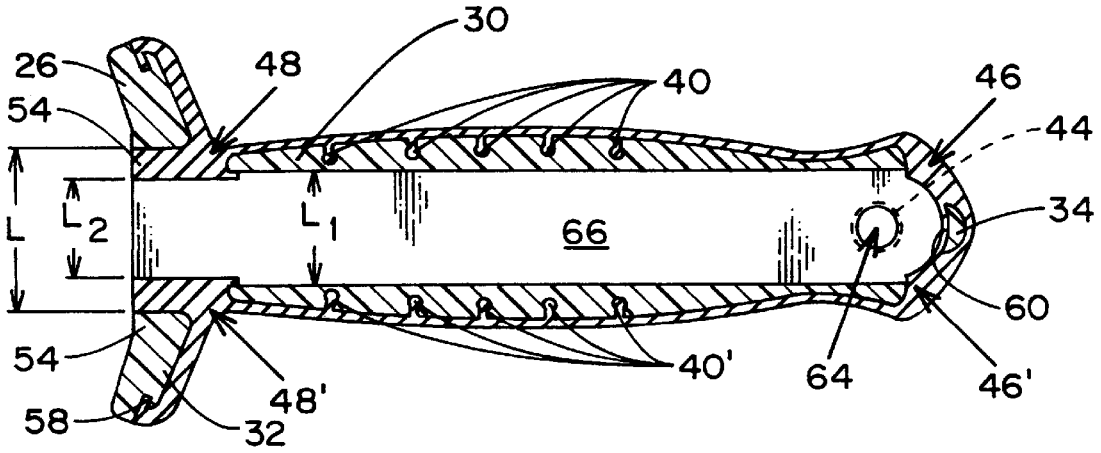
FIGS. 3 and 4 are elevational views in section on the lines 3—3 and 4—4, respectively, of FIG. 1.
Figure 4:
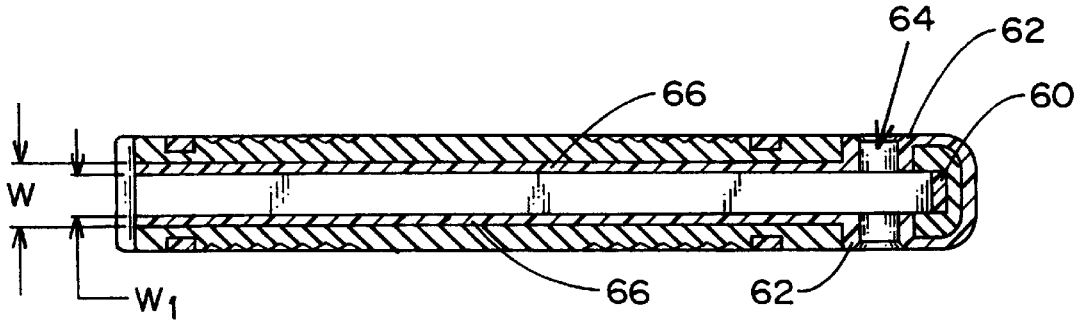

The portion of the internal cavity in frame 20 extending from opening 28 through guard 26 and transitional portion 32 has a length L and width W, as indicated in FIGS. 3 and 4, respectively. The length of the long side of the cavity is reduced to $L_1$ in body 30, while width W remains constant throughout the length of the cavity. The cross-sectional configuration of the portion of the cavity within body 30 is seen in FIG. 9. Although considered for purposes of description to be substantially rectangular, it will be noted that the two longer sides include narrow strips 50 extending along opposite sides, with undercuts 52 extending under strips 50.

As previously mentioned, after frame 20 has been formed in first mold 22 it is placed in second mold 24 wherein the second material is applied as a coating layer on certain portions of the frame. A layer of the second material is applied in uniform thickness to all four walls of that portion of the frame cavity extending from opening 28 through guard 26 and transitional portion 32. This portion of the second material is denoted by reference numeral 54 and forms rectangular opening 56, concentrically disposed within opening 28 and having a length $L_2$ and width $W_1$, as indicated in FIGS. 3 and 4, respectively.

Figure 5:
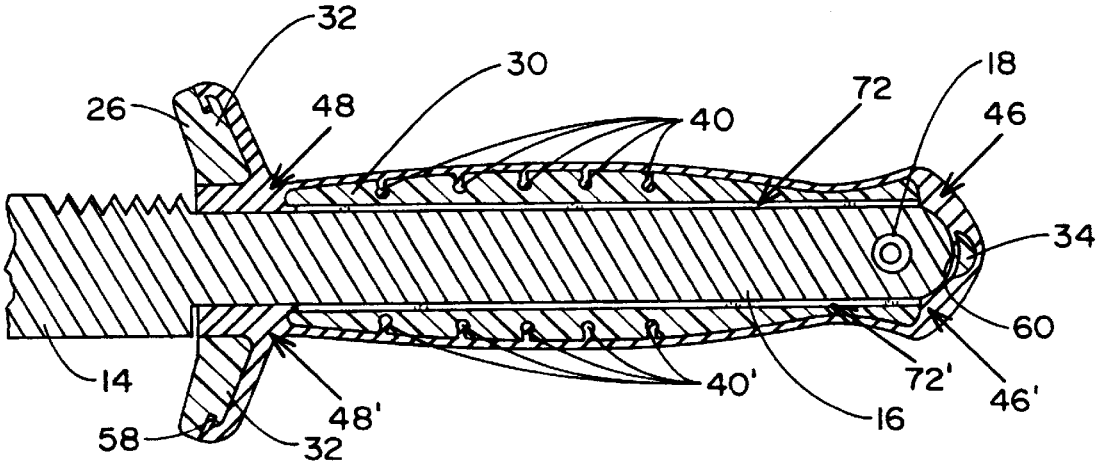
FIGS. 5 and 6 are elevational views in section on the lines 5—5 and 6—6, respectively, of FIG. 2.
Figure 6:
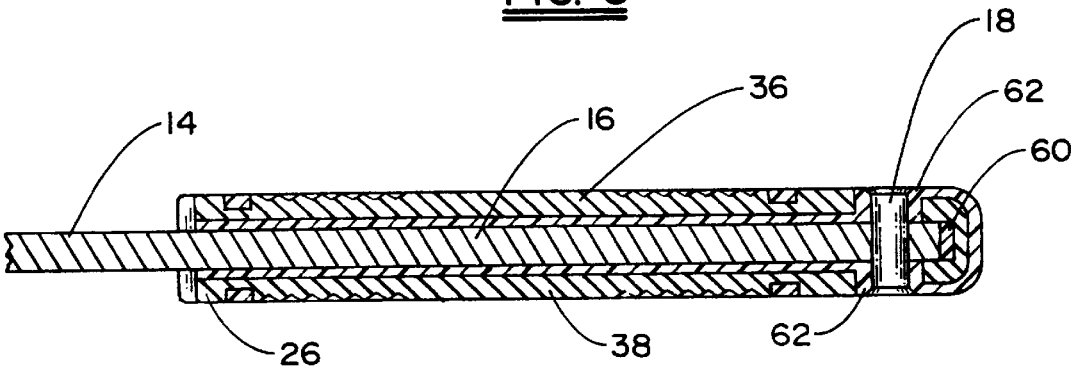

The layer of second material, as seen in FIGS. 3 and 5, covers transitional portion 32, filling undercut 58 which extends fully about the juncture of guard 26 and transitional portion 32, and communicating through openings 48 and 48' with portion 54, providing integral continuity of the internal and external portions of the second material adjacent the distal end. Body portion 30, including protrusion 34, is covered by a layer of the second material, leaving the outer surfaces of side pieces 36 and 38 and ribs 42 exposed. The second material flows through and fills passageways 40 and 40', creating a mechanical bond of the second material to body 30.

In the portion of the cavity within body 30, the second material covers the longer sides, flowing into undercuts 52 and communicating through openings 46 and 46' with the portion of the second material on the exterior of body 30 at the proximal end. It is also important to note that the second material covers the inner side of protrusion 34, this portion of the second material being indicated in FIGS. 3–6 by reference numeral 60. Furthermore, the second material covers the portions of frame 20 which define opening 44, whereby such portions 62 of the second material define through opening 64, concentrically disposed within opening 44. The layers of the second material covering the longer sides of the cavity are denoted by reference numeral 66. As is evident from FIGS. 4 and 6, opposing surfaces of portions 66 are planar and equally spaced throughout the axial length of the cavity. Although portions 66 cover all of the longer sides of the cavity in frame 20, the layer covering strips 50 is considerably thinner than that covering the central portion, as is evident in FIG. 9.

Figure 10:
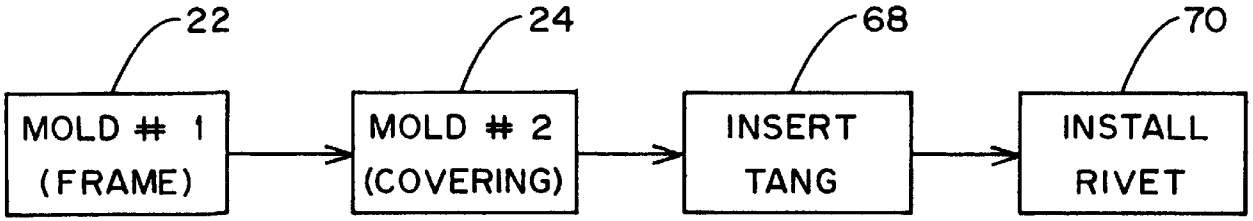
FIG. 10 is a block diagram illustrating sequential steps in the preferred method of fabrication of the knife.

Following application of the second material, fabrication of handle 12 is complete. Tang 16 is then inserted into the handle cavity. The width of tang 16 is slightly (e.g., a few thousandths of an inch) greater than $L_2$ and its thickness is slightly greater than $W_1$, i.e., the space between the opposing surfaces of portions 66. Thus, tang 16 is inserted into the cavity with an interference fit. When fully inserted, an opening in the tang is aligned with and positioned between the two parts of opening 64. Fabrication of knife 10 is complete upon insertion of tang 16 into the handle cavity and installation of rivet 18, steps represented in FIG. 10 by blocks 68 and 70.

Although slightly greater than $L_2$, the width of tang 16 is less than $L_1$. Therefore, as seen in FIG. 5, the longitudinal edges of tang 16 are spaced from the walls of the cavity within body 30 of frame 20, providing the narrow spaces indicated by reference numerals 72, 72'. Tang 16 is contacted by portion 54 of the second material on both its major surfaces and its longitudinal edges, and by portions 66 over both major surfaces within frame body 30. Furthermore, portion 60 of the second material, as well as those portions interiorly of openings 46 and 46', form an abutment for the curved, proximal end of tang 16. Thus, tang 16 is completely isolated from rigid frame 20, contacting only the resilient second material and rivet 18 rivet 18 also is isolated from contact with the frame by portions 62 of the second material. Although FIG. 9 is a cross section of the frame only, the areas occupied by the second material after completion of the handle are indicated by dot-dash lines, and the area where tang 16 is installed is indicated by dash lines, spaces 72, 72' between the edges of the tang and frame 20 also being indicated.

What is claimed is:

1. A knife handle having proximal and distal ends and a longitudinal axis, said handle comprising:

a) a frame of thermosetting, dimensionally stable, rigid material extending from said distal end substantially to said proximal end and having an external surface and wall means defining an elongated cavity open at said distal end and extending along said axis toward said proximal end; and b) a cover and lining of resilient material bonded to said rigid material, a first portion of said resilient material covering at least portions of said wall means within said cavity, and a second portion of said resilient material forming a layer covering at least portions of said external surface, and wherein an opening entirely surrounded by said resilient material extends through said handle transversely of said longitudinal axis.

2. The knife handle of claim 1 wherein said first and second portions of said resilient material are contiguous with one another at a plurality of positions on said handle.

3. The knife handle of claim 2 wherein said first and second portions are contiguous in areas adjacent both said proximal and distal ends.

4. The knife handle of claim 1 wherein said opening is substantially adjacent said proximal end.

5. The knife handle of claim 1 wherein said cavity is substantially rectangular in planes transverse to said longitudinal axis.

6. The knife handle of claim 5 wherein the two longer sides of said rectangular cavity are substantially entirely covered by said first portion of said resilient material throughout the length of said cavity.

7. The knife handle of claim 6 wherein said frame includes a guard at said distal end, a body portion extending from said proximal end for the majority of the length of said frame, and a transitional portion integrally connecting said guard and said body portion, and the two shorter sides of said rectangular cavity are substantially entirely exposed at least within said body portion.

8. The knife handle of claim 1 wherein said second portion of said resilient material completely covers said rigid material external surface at said proximal end.

9. A knife handle having proximal and distal ends and a longitudinal axis, said handle comprising:

a) a frame of thermosetting, dimensionally stable, rigid material extending from said distal end substantially to said proximal end and having an external surface and wall means defining an elongated cavity open at said distal end and extending along said axis toward said proximal end; and b) a cover and lining of resilient material bonded to said rigid material, a first portion of said resilient material covering at least portions of said wall means within said cavity, and a second portion of said resilient material forming a layer covering at least portions of said external surface, and wherein an opening entirely surrounded by said resilient material extends through said handle transversely of said longitudinal axis wherein said wall means includes an end wall at the terminus of said cavity and said end wall is substantially entirely covered by said first portion of said resilient material.

10. A fixed-blade knife comprising:

a) a blade having at least one cutting edge;

b) a tang of predetermined width and thickness extending integrally from said blade;

c) a handle having proximal and distal ends formed of two, diverse materials, one rigid and the other resilient, said rigid material having an exterior surface and interior walls defining a cavity extending from an open end at said distal end substantially to said proximal end, said resilient material including a first portion covering at least a portion of said exterior surface and a second portion covering at least a portion of said interior walls; and d) means fixedly attaching said tang to said handle with said tang positioned within said cavity without contacting said rigid material.

11. The knife of claim 10 wherein said tang has a terminal end opposite its juncture with said blade and said resilient material forms an abutment surface contacting said terminal end.

12. The knife of claim 10 wherein said tang has a terminal end opposite its juncture with said blade, and said fixedly attaching means comprises a rivet passing through aligned openings in said tang and said handle.

13. The knife of claim 12 wherein said resilient material completely surrounds the opening in said handle, whereby said rivet contacts only said resilient material and said tang.

14. The knife of claim 10 wherein said rigid material includes a plurality of openings filled by said resilient material, thereby forming a mechanical bond between said rigid and resilient materials.

15. The knife of claim 10 wherein said open end is rectangular and the walls of said cavity extending inwardly from said open end are completely covered by said resilient material.

16. The knife of claim 15 wherein said rigid material exterior surface is entirely exposed at said distal end, forming a guard for said handle.

17. The method of constructing a knife having a handle and a blade with an integral tang, said method comprising:

a) forming in a first mold a frame of rigid, thermosetting plastic material, said frame extending between proximal and distal ends and having an external surface and internal walls defining a cavity extending from an open end at said distal end substantially to said proximal end;

b) placing said frame in a second mold and forming therein a cushioning layer of resilient material bonded to said frame in covering relation to at least portions of both said external surface and said internal walls;

c) inserting said tang into said cavity to contact therein only said resilient material, said frame and cushioning layers thereby forming said handle; and d) fixedly attaching said tang to said handle.

18. The method of claim 17 wherein said tang is attached to said handle by a rivet passing transversely through said handle in spaced relation to said frame.

19. The method of claim 18 wherein said rivet passes through aligned openings in said tang and said handle in contact only with said tang and said resilient material.

* * * * *